US006533148B1

(12) United States Patent
Dahl

(10) Patent No.: US 6,533,148 B1
(45) Date of Patent: Mar. 18, 2003

(54) BEVERAGE BOTTLE CARRIER

(76) Inventor: Phyllis S. Dahl, 3486 King Rd., Liberty, MS (US) 39645

( * ) Notice: Subject to any disclaimer, the term of this patent is extended or adjusted under 35 U.S.C. 154(b) by 0 days.

(21) Appl. No.: 10/004,069

(22) Filed: Oct. 25, 2001

(51) Int. Cl.[7] ..... A45F 5/00

(52) U.S. Cl. ..... 224/148.6; 224/607; 224/609; 294/87.2; D3/229

(58) Field of Search ..... 224/148.6, 148.5, 224/607, 609; 294/87.2; D3/207, 229

(56) References Cited

U.S. PATENT DOCUMENTS

| | | | | | |
|---|---|---|---|---|---|
| 2,970,729 | A | * | 2/1961 | Allen | 294/87.2 |
| 3,297,220 | A | | 1/1967 | Leeberg | |
| 3,543,976 | A | * | 12/1970 | Ronald | 224/148.6 |
| 3,702,203 | A | * | 11/1972 | Oltmanns | 294/87.2 |
| 4,483,470 | A | * | 11/1984 | Cousins | 224/607 |
| 4,678,221 | A | | 7/1987 | Josenhams | |
| 4,776,622 | A | | 10/1988 | Ross | |
| 4,984,724 | A | * | 1/1991 | Johnston | 224/609 |
| 5,096,246 | A | | 3/1992 | Cnare | |
| D347,734 | S | * | 6/1994 | Patterson et al. | D3/229 |
| 5,437,401 | A | | 8/1995 | Seltzer | |
| 5,441,320 | A | | 8/1995 | Strong | |
| 5,480,204 | A | * | 1/1996 | Erickson | 294/87.2 |
| RE35,288 | E | | 7/1996 | Borg | |
| 5,603,545 | A | | 2/1997 | Benson et al. | |
| 5,695,232 | A | | 12/1997 | Tipp | |
| 5,735,562 | A | | 4/1998 | Borg | |
| 5,927,781 | A | | 7/1999 | Lyons, Jr. | |
| 5,938,256 | A | * | 8/1999 | Lovette | 294/87.2 |
| 6,029,870 | A | | 2/2000 | Giacona, III | |
| 6,076,874 | A | * | 6/2000 | Lovette | 294/87.2 |
| 6,352,235 | B2 | | 3/2002 | Cizek | |
| 6,446,849 | B1 | * | 9/2002 | Schleifer | 224/258 |

* cited by examiner

*Primary Examiner*—Stephen P. Garbe
(74) *Attorney, Agent, or Firm*—David L. Ray

(57) ABSTRACT

A beverage bottle carrier apparatus for enabling an individual to carry one or more beverage bottles. The beverage bottle carrier of the invention includes an elongated generally rectangular flexible strap having a handle portion in the approximate middle thereof for easy grasping by a hand of a person carrying one or more beverage bottles, the flexible strap having two ends and a buckle assembly for connecting the two ends together, one end of the strap having a male portion of the buckle assembly connected thereto and the other end of the strap having a female portion of the buckle assembly connected thereto, and a hooking mechanism connected to said male portion and said female portion, the hooking mechanism being adapted to be force-fitted around the neck of a beverage bottle to grasp and hold a beverage bottle therein.

20 Claims, 2 Drawing Sheets

BEVERAGE BOTTLE CARRIER

BACKGROUND OF THE INVENTION

1. Field of the Invention

The present invention relates to apparatus for carrying beverage bottles. In particular the present invention relates to devices having straps which are connected to beverage bottles and held by the hands of the person carrying the beverage bottles or carried draped over and supported by another portion of the carrier's body such as the shoulder or the waist.

2. Description of the Related Art

Beverage bottles come in a large variety of shapes and sizes. Beverage bottles are commonly made of polymeric materials which do not shatter as glass containers do when dropped. Such polymeric beverage bottles are commonly made in large one, two, and three liter sizes which are heavy and difficult to carry by hand.

Such beverage bottles are commonly transported to beaches and other recreational areas from a vehicle to an area where the beverages are consumed. When individuals need to carry such bottles, beverage bottle carriers are needed to enable an individual to carry the bottles more easily than grasping the bottles individually by hand.

Beverage bottle carriers are known in the art. Exemplary of the Patents of the related art are the following U.S. Pat. Nos. 3,297,220; 4,678,221; 4,776,622; 5,096,246; 5,437,401; 5,441,320; U.S. Pat. No. Re. 35,288; U.S. Pat. Nos. 5,603,545; 5,695,232; 5,735,562; 5,927,781 and 6,029,870.

BRIEF SUMMARY OF THE INVENTION

In accordance with the present invention there is provided an apparatus for enabling individual to carry one or more beverage bottles. The beverage bottle carrier of the invention includes an elongated generally rectangular flexible strap having a handle portion in the approximate middle thereof for easy grasping by a hand of a person carrying one or more beverage bottles, the flexible strap having two ends and a buckle assembly for connecting the two ends together, one end of the strap having a male portion of the buckle assembly connected thereto and the other end of the strap having a female portion of the buckle assembly connected thereto, and a hooking mechanism connected each of the male and female portions, the hooking mechanism being adapted to be force-fitted around the neck of a beverage bottle to grasp and hold a beverage bottle therein.

The beverage bottle carrier of the invention has the advantage of being quickly and easily connected to the neck of a beverage bottle for lifting, supporting, and transporting a beverage bottle.

The beverage bottle carrier of the invention has the additional advantage of being light weight and inexpensive.

DETAILED DESCRIPTION OF THE INVENTION

Figure 1:
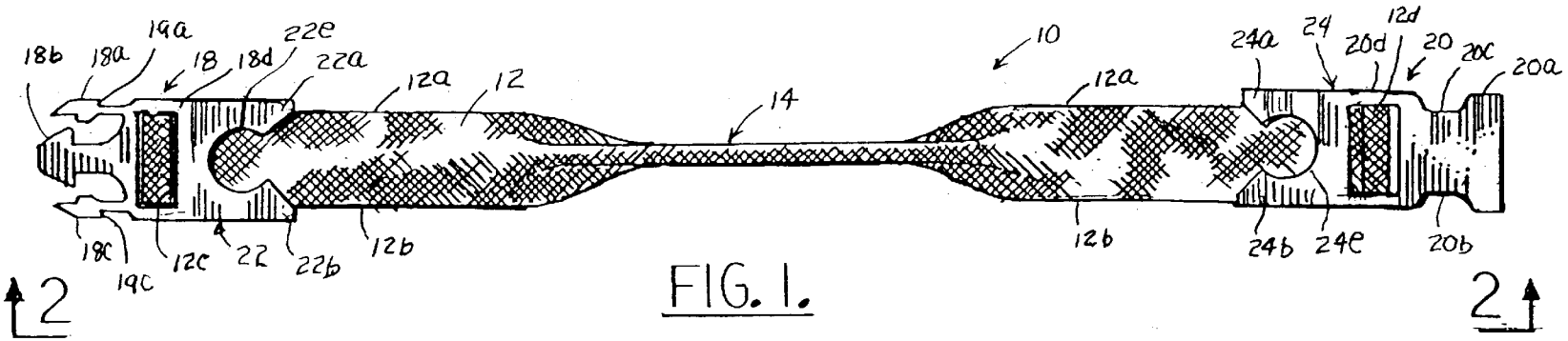
FIG. 1 is top plan view of the beverage bottle carrier of the invention.
Figure 2:
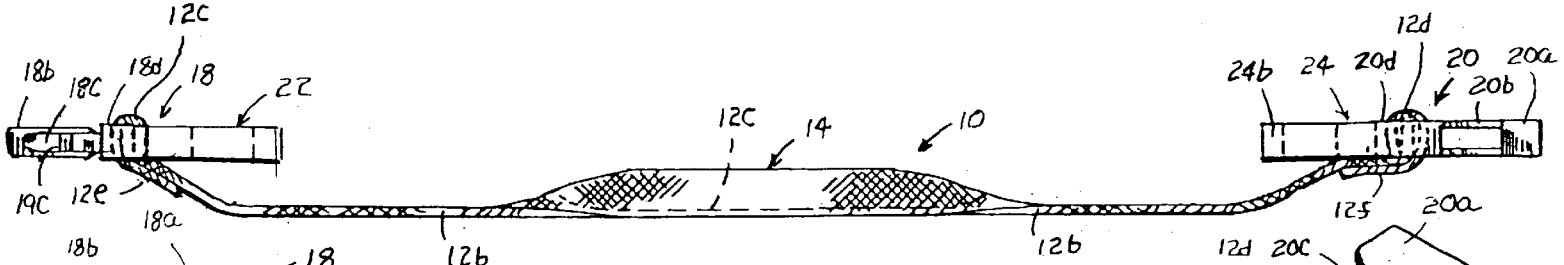
FIG. 2 is side elevational view of the beverage bottle carrier of the invention.

Referring now to the drawings, and in particular to FIGS. 1 and 2, the beverage bottle carrier of the invention is generally indicated by the numeral 10.

Beverage bottle carrier 10 includes a flat, generally rectangular elongated strap 12 having a handle portion generally indicated by the numeral 14 in the center thereof preferably formed by folding the opposite edges 12*a* and 12*b* of rectangular strap together and connecting the edges. Edges 12*a* and 12*b* are connected together at the approximate center of strap by sewing, heat sealing, or the like at seam 12*c* to form handle portion 14.

Elongated strap 12 is preferably made from a woven flexible polymeric plastic material well known in the art. However, if desired, elongated strap 12 could be made from a solid flexible polymeric strip, leather, woven natural or synthetic fibers, or the like.

Figure 4:
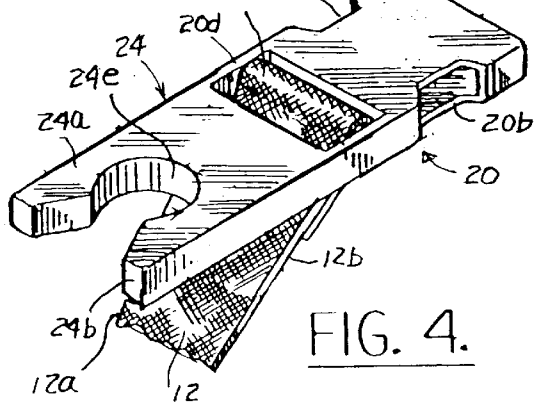
FIG. 4 is an enlarged partly cut-away perspective view of the female portion of the buckle assembly of the beverage bottle carrier of the invention.
Figure 3:
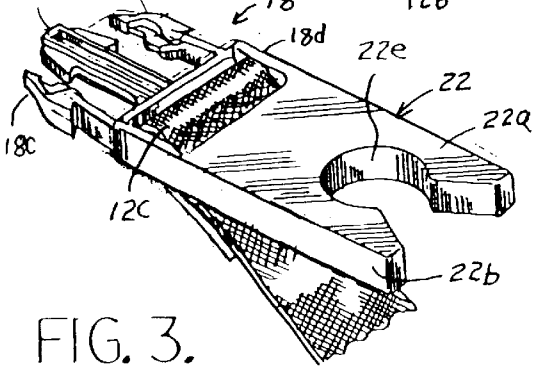
FIG. 3 is an enlarged partly cut-away perspective view of the male portion of the buckle assembly of the beverage bottle carrier of the invention.
Figure 5:
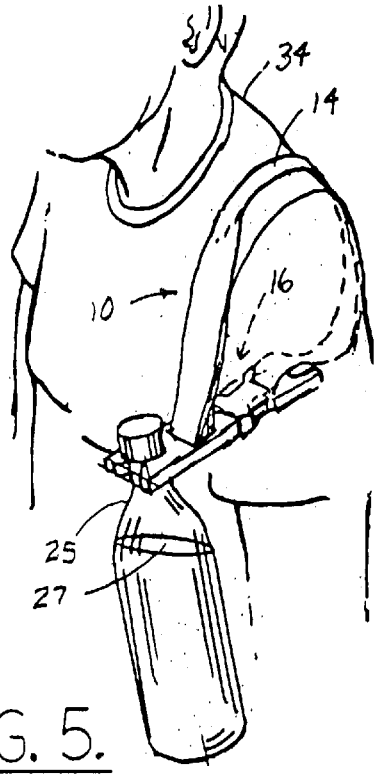
FIG. 5 is a partly cut-away perspective view of the beverage bottle carrier of the invention shown draped over the shoulder of a person carrying a beverage bottle, part of the beverage bottle carrier of the invention being shown in phantom lines
Figure 7:
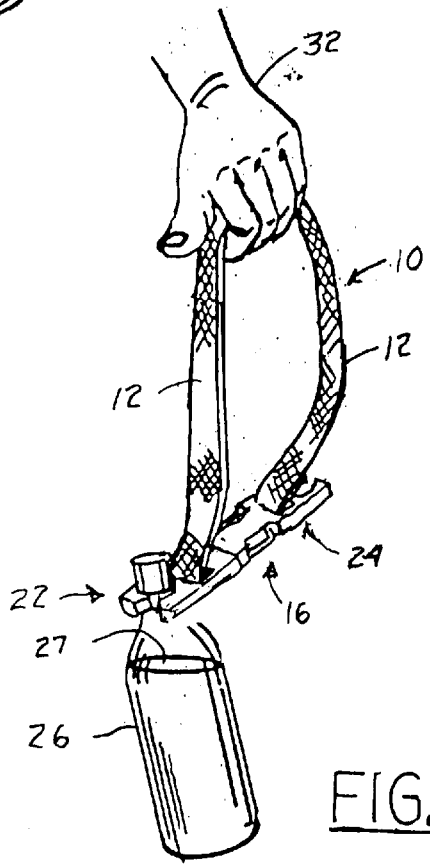
FIG. 7 is a partly cut-away perspective view of the beverage bottle carrier of the invention shown supported by the hand of a person carrying a single beverage bottle.

A buckle assembly generally indicated by the numeral 16 in FIGS. 5 and 7 is used to connect each of the two ends of elongated strap 12 together. Buckle assembly 16 includes a male portion generally indicated by the numeral 18 in FIGS. 1–3 and a female portion generally indicated by the numeral 20 in FIGS. 1, 2 and 4 connected to each of the two ends of elongated strap 12.

Male portion 18 includes three generally parallel flexible prongs 18*a*, 18*b*, and 18*c* which are integrally formed with a clasp 18*d*. One end of strap 12 is received in clasp 18*d* and connected thereto to form loop 12*c* in strap 12 by connecting the end of strap 12 to strap 12 at 12*e* by sewing, riveting, or the like.

Female portion 20 has a hollow body 20*a* for receipt of prongs 18*a*, 18*b*, and 18*c* with openings 20*b* and 20*b* in opposite sides thereof for receipt of the outer shoulders 19*a* and 19*c* on prongs 18*a* and 18*c*, respectively, to selectively lock prongs 18*a* and 18*c* therein. Prongs 18*a*, 18*b*, and 18*c* are force fitted into hollow body 20*a* to fasten male portion 18 to female portion 20. Prongs 18*a* and 18*c* are depressed toward center prong 18*b* to release male portion 18 from female portion 20. Body 20*a* is integrally formed with a clasp 20*d*. The other end of strap 12 is received in clasp 20*d* and connected thereto to form loop 12*d* in strap 12 by connecting the end of strap 12 to strap 12 at 12*f* by sewing, riveting, or the like.

Two U-shaped flexible hooks generally indicated by the numerals 22 and 24 are integrally formed with clasps 18*d* and 20*d*, respectively. Hook 22 has a U-shaped body formed by two flexible parallel prongs 22*a* and 22*b*, and hook 24 has a U-shaped body formed by two flexible parallel prongs 24*a* and 24*b*. Prongs 22*a* and 22*b* have a semi-circular portion 22*e* adjacent to clasp 22*c* for snug receipt of the circular neck 25 of a beverage bottle 26 having a liquid 27 therein as shown in FIGS. 5–7 when the neck of beverage bottle 26 is force fitted therebetween, and prongs 24*a* and 24*b* have a semi-circular portion 24*e* adjacent to clasp 24*c* for snug receipt of the circular neck of a beverage bottle 26 as shown in FIGS. 5–7 when the neck of bottle 26 is force fitted therebetween.

To utilize the beverage bottle carrier of the invention, one beverage bottle 26 is connected to beverage bottle carrier 10 as shown in FIGS. 5 and 7 by force fitting the neck 25 of bottle 26 into hook 22 or 24, and male portion 18 may be buckled to female portion 20. The handle 14 of beverage bottle carrier 10 may then be grasped by the hand 32 of the user 34 to lift and carry beverage bottle 26 as shown in FIG. 7, or buckled beverage bottle carrier 10 may be placed over the shoulder of the user 34 as shown in FIG. 5. If desired, one beverage bottle 26 could be placed in hook 22 and another beverage bottle 26 could be placed in hook 24, and beverage bottle carrier 10 having two bottles attached thereto could be carried by the user 34 as shown in FIG. 5 or FIG. 7.

Figure 6:
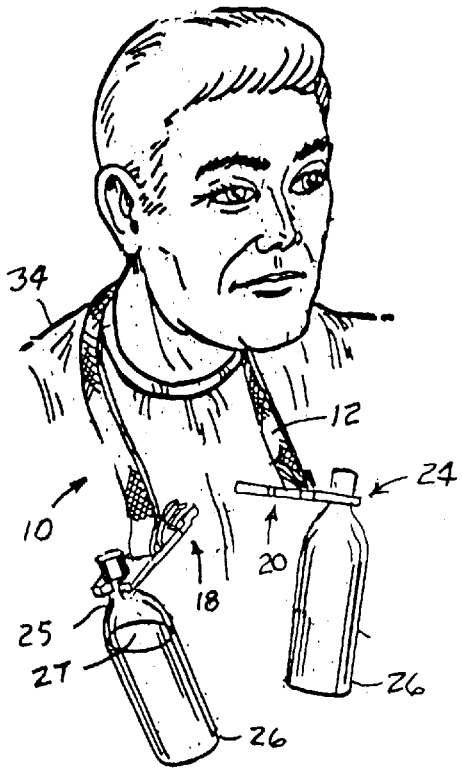
FIG. 6 is a partly cut-away perspective view of the beverage bottle carrier of the invention shown draped around the neck of a person carrying two beverage bottles.

Furthermore, as shown in FIG. 6, one beverage bottle 26 could be placed in hook 22 and another beverage bottle 26 could be placed in hook 24, and beverage bottle carrier 10 having two bottles attached thereto could be carried by the user 34 by draping strap 12 around the neck of the user 34.

Although the preferred embodiments of the invention have been described in detail above, it should be understood that the invention is in no sense limited thereby, and its scope is to be determined by that of the following claims.

What is claimed is:

1. A beverage bottles carrier apparatus for beverage bottles, each of said bottles having a neck, said apparatus comprising an elongated generally rectangular flexible strap, said strap having two terminal ends, said strap having a handle portion located between said two terminal ends of said strap in the approximate middle of said strap, said strap having a buckle assembly connected thereto, said buckle assembly having a male portion and a female portion for selectively connecting each of said two terminal ends together, said male portion being adapted to be received in said female portion, one of said two terminal ends of said strap having said male portion of said buckle assembly connected thereto, the other of said two terminal ends of said strap having said female portion of said buckle assembly connected thereto, said male portion and said female portion each having a hook mechanism connected thereto, each of said two hook mechanisms being adapted to be force-fitted around said neck of one of said beverage bottles to grasp and hold said neck of one of said beverage bottles therein.

2. The apparatus of claim 1 wherein each of said hook mechanisms has two prongs.

3. The apparatus of claim 2 wherein said two prongs are generally parallel.

4. The apparatus of claim 3 wherein said two prongs have a semi-circular portion between said two prongs adapted to receive said neck of said beverage bottle.

5. The apparatus of claim 4 wherein said two prongs are connected to a said male portion.

6. The apparatus of claim 4 wherein said two prongs are connected to a female portion.

7. The apparatus of claim 1 wherein said male portion has a clasp connected thereto.

8. The apparatus of claim 7 wherein said strap has a loop connected at one of said two terminal ends of said strap, and said clasp is adapted to receive said loop to connect said male portion to said strap.

9. The apparatus of claim 8 wherein said male portion has a plurality of prongs connected to said clasp.

10. The apparatus of claim 9 wherein said plurality of prongs are parallel.

11. The apparatus of claim 10 wherein said plurality of prongs are received in said female portion.

12. The apparatus of claim 11 wherein two of said plurality of prongs have shoulders thereon which lock into said female portion when received therein.

13. The apparatus of claim 1 wherein said female portion has a clasp connected thereto.

14. The apparatus of claim 13 wherein said strap has a loop connected at one of said two terminal ends of said strap, and said clasp is adapted to receive said loop to connect said male portion to said strap.

15. A beverage bottle carrier apparatus for carrying beverage bottles, each of said bottles having a neck, said apparatus comprising an elongated generally rectangular flexible strap means for supporting said beverage bottles, said strap means having two terminal ends, said strap means having handle means located between said two terminal ends of said strap means in the approximate middle of said strap means for grasping said apparatus, said strap means having a buckle means for selectively connecting each of said two terminal ends together, said buckle means having a male portion and a female portion for selectively connecting each of said two terminal ends together, said male portion being adapted to be received in said female portion, one of said two terminal ends of said strap means having said male portion of said buckle means connected thereto, the other of said two terminal ends of said strap means having said female portion of said buckle means connected thereto, said male portion and said female portion each having a hook means connected thereto, each of said two hook means being adapted to be force-fitted around said neck of one of said beverage bottles to grasp and hold said neck of one of said beverage bottles therein.

16. The apparatus of claim 15 wherein each one of said hook means has two prongs.

17. The apparatus of claim 16 wherein said two prongs are generally parallel.

18. The apparatus of claim 17 wherein said two prongs have a semi-circular portion between said two prongs adapted to receive said neck of one of said beverage bottles.

19. The apparatus of claim 18 wherein said two prongs are connected to said female portion.

20. The apparatus of claim 18 wherein said two prongs are connected to said female portion.

* * * * *